United States Patent [19]

Amit

[11] Patent Number: 4,923,460

[45] Date of Patent: May 8, 1990

[54] SPRING ELEMENT FOR HAIR-REMOVAL DEVICE

[75] Inventor: Noah Amit, Haifa, Israel

[73] Assignee: Aris Enterprises, Ltd., New York, N.Y.

[21] Appl. No.: 319,433

[22] Filed: Mar. 3, 1989

[30] Foreign Application Priority Data

Jan. 23, 1989 [IL] Israel ..... 089037

[51] Int. Cl.[5] ..... A61B 17/00

[52] U.S. Cl. ..... 606/133; 17/47

[58] Field of Search ..... 128/355; 17/11.1 R, 17/47; 132/73, 73.6; 606/131, 133

[56] References Cited

U.S. PATENT DOCUMENTS 1,232,617 7/1917 Shipp ..... 606/133

4,524,772 6/1985 Daar et al. ..... 128/355

FOREIGN PATENT DOCUMENTS 0268696 9/1950 Switzerland ..... 128/355

*Primary Examiner*—Michael H. Thaler
*Assistant Examiner*—William Lewis
*Attorney, Agent, or Firm*—Jordan and Hamburg

[57] ABSTRACT

A hair removal device comprising a wire shaped in the configuration of a coil spring having a plurality of loops and an arcuate axis and a handle mounting the coil spring for rotation of the spring about the axis, the surfaces of the wire being roughened about the entire circumference and along the entire length of the wire so that mutually opposed surfaces of adjacent loops of the spring are roughened, whereby the performance or the hair removal device is substantially enhanced.

4 Claims, 1 Drawing Sheet

SPRING ELEMENT FOR HAIR-REMOVAL DEVICE

FIELD OF THE INVENTION

The present invention relates to personal care hygiene and grooming accessories, and more particularly, to an improved spring element for use in hair-removal devices which pluck hair from the skin by action of a moving or rolling coil spring.

BACKGROUND OF THE INVENTION

The prior art of depilatory (hair-removal) devices includes variations of a well-known technique, namely, moving or rolling of a coil spring over the surface of the skin to pluck out hair which becomes trapped between the loops of the spring. An example of a moving spring design is described in U.S. Pat. No. 4,524,772 to Daar et al, in which a motor-powered spring moves in an endless loop and grabs hair between loops of the spring, providing a pulling action and removing the hair at its roots.

An example of a rolling spring design is described in Swiss patent 268,696 to Fischer, in which an arched spring is placed on the skin under slight pressure and moved against the direction of the hair growth, such that the spring rolls on the skin. It is specifically mentioned in the Fischer patent that the outside of the spring can be roughened by the provision of notches, thereby facilitating the rolling process on the skin.

The effectiveness of each of the prior art designs described above depends in large measure on the degree of certainty with which hairs falling between loops of the spring are grasped and eventually pulled out. Since the inner-facing coil spring surfaces are smooth, the possibility exists that hairs will slide out from between individual loops and not be removed.

Therefore, it would be desirable to provide a spring element for use in mechanical hair-removal devices which ensures a greater degree of effectiveness than that presently available.

SUMMARY OF THE INVENTION

Accordingly, it is a principal object of the present invention to provide an improved spring element for use in mechanical hair-removal devices which ensures a greater degree of effectiveness in grasping and pulling out skin hair. The inventive spring element is treated during the production stage such that the inner-facing surfaces between individual loops and outer-facing surfaces are roughened by one of several methods.

In accordance with the present invention, there is provided an improved spring element of the coil-type used in hair-removal devices, wherein the improvement comprises roughened coil spring inner-facing and outer-facing surfaces.

In the preferred embodiment, the roughened coil spring inner-facing and outer-facing surfaces of the inventive spring element are provided by treatment of the spring material prior to its formation as a coil spring. For example, in the case of wire spring material which is drawn into a coil spring shape, the wire is first passed through a roughener in which it is sand-blasted, such that its entire external surface is pitted. When drawn into a coil spring shape, the pitted external surfaces of the wire provide roughened coil spring inner-facing and outer-facing surfaces, which increase the effectiveness of the coil spring in grasping and pulling out hair as it travels over the skin.

Alternatively, as the wire passes through the roughener, it is subjected to contact the rotating wire brushes which roughen its entire external surface. As before, when formed into a coil spring, the inner-facing and outer-facing surfaces are roughened, increasing the spring element effectiveness when used in a hair removal device.

In still another approach, the wire passes through the roughener in which an acid bath is contained, such that its external surface is etched by chemical reaction and thereby roughened.

By provision of the improved spring element with roughened inner-facing and outer-facing surfaces, hair which is trapped between individual loops will be plucked with a greatly increased degree of certainty, promoting overall effectiveness of the hair-removal device.

In addition, for the rolling spring hair-removal device, since the outer-facing surface of the coil spring is also roughened, greater rolling friction is obtained, increasing the ease with which the device performs its hair-removal function.

Other features and advantages of the invention will become apparent from the drawings and description contained herein below.

BRIEF DESCRIPTION OF THE DRAWINGS

For a better understanding of the invention, reference is made to the accompanying drawings in which.

DETAILED DESCRIPTION OF A PREFERRED EMBODIMENT

Figure 1:
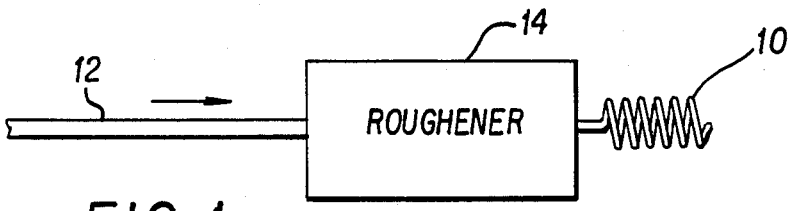
FIG. 1 is a schematic diagram of a production process for a spring element constructed in accordance with the principles of the present invention.

Referring now to FIG. 1, there is shown a schematic diagram of a production process for an improved spring element 10 constructed and operated in accordance with the principles of the present invention. Spring element 10 is typically constructed of wire material 12, which is fed to a roughener 14 before being formed with a coil spring shape. Roughener 14 is designed to treat the external surface of wire 12, by providing it with a roughened texture. When spring element 10 is formed in a coil shape, the inner-facing coil spring surfaces as well as the outer-facing ones will have this roughened texture.

Roughener 14 may be provided in several alternative embodiments. In one approach, roughener 14 employs a sandblasting technique, in which the straight wire 12 is drawn (see arrow) through a chamber in which sand particles provide its external surface with a pitted, roughened texture. The choice of sand particle average diameter and duration of the treatment in relation to wire 12 thickness will determine the degree of spring element 10 roughenss.

Alternatively, roughener 14 may be provided as an acid bath treatment, in which the external surface of wire 12 is etched to provide a rough texture. Choice of acid strength and duration of the treatment in relation to wire 12 thickness will determine spring element 10 roughness. In still another approach, roughener 14 may be provided as a series of wire brushes which scratch the external surface of wire 12, providing spring element 10 with a roughened texture.

Alternative embodiments of roughener 14 may be envisioned, all in keeping with the requirement of treating the external surface of wire 12, to provide spring element 10 with a roughened texture on inner-facing and outer-facing surfaces.

It will be appreciated that although the production process of FIG. 1 contemplates treatment of wire 12 prior to forming the coil spring shape of improved spring element 10, it is also possible to treat existing coil springs in this fashion, with similar results.

Figure 2:
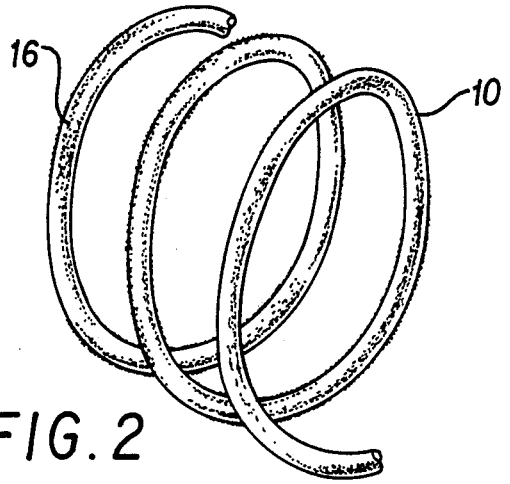
FIG. 2 is a magnified view of the inventive spring element, shown in perspective and featuring roughened coil spring inner-facing and outer-facing surfaces.

Referring now to FIG. 2, there is shown an enlarged perspective view of spring element 10, showing its roughened texture 16, which is the result of the treatment provided by roughener 14 of the production process shown in FIG. 1. Because it has been treated by roughener 14 prior to being formed in the shape of a coil spring, spring element 10 is provided with roughened texture 16 on all of its external surfaces. Thus, coil spring inner-facing surfaces between individual loops of spring element 10 are also provided with roughened texture 16. As described further herein, this feature provides spring element 10 with particular advantages when it is applied in hair-removal devices.

Figure 3:
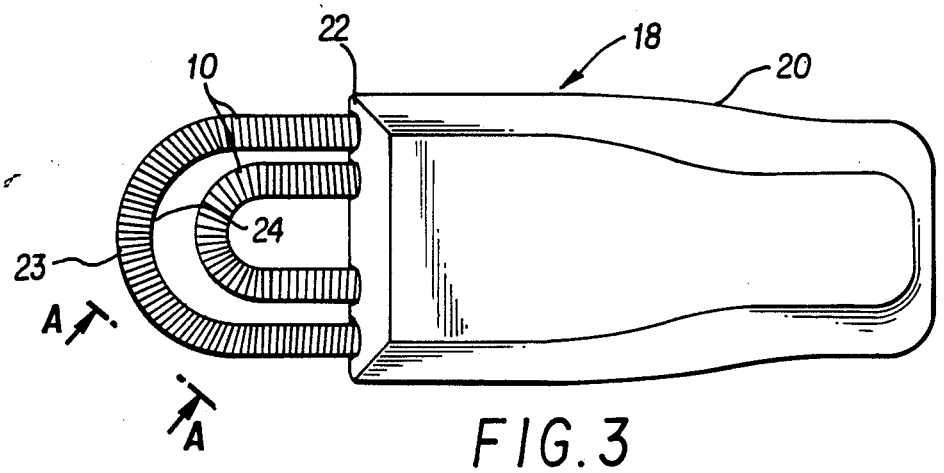
FIG. 3 is a top plan view of a hair removal device in which the inventive spring element issued.

Referring now to FIG. 3, there is shown a top plan view of a hair-removal device 18 utilizing spring element 10. Device 18 comprises a handle 20 having one end 22 which retains the ends of each of a pair of lengths of spring element 10. The ends of each of the spring element 10 lengths are retained in freely rotatable fashion by end 22 of handle 20, such that when placed against the skin, rolling friction causes spring element 10 to roll between forward and rear portions 23 and 24 thereof when handle 20 is moved forward. As will be appreciated, a more even rolling operation is provided, since rolling friction is increased by the roughened texture 16 of spring element 10 outer-facing surfaces.

Figure 4:
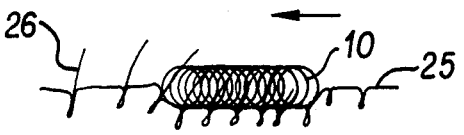
FIG. 4 is a cross-sectional view of the inventive spring element taken along section lines A—A of FIG. 3.

As shown in the cross-section of FIG. 4 taken along section lines A—A of FIG. 3, rolling action of spring element 10 against the skin 25 forms the basis of its hair-removal function as it comes in contact with individual hairs 26. As they become trapped in the openings between loops of the forward portion 23 of spring element 10, hairs 26 are plucked from skin 25 by rolling action when they encounter the rear portion 24 of spring element 10.

Because roughened texture 16 is provided on the inner-facing surfaces between loops of spring element 10, increased friction is present when individual hairs 26 come into contact with these inner-facing loop surfaces. As a result of this increased friction, hairs 26 becoming trapped between loops of spring element 10 are less likely to slide out and are plucked from skin 24 with a greater degree of certainty. Thus, overall performance of hair-removal device 18 is increased, by as much as a three-to-one ratio over hair-removal devices using a spring element which has not been subjected to the treatment shown in the production process of FIG. 1.

It will be appreciated that the improved spring element 10 of the present invention can be applied to mechanical hairremoval devices such as that shown in FIG. 3, and also to those hair removal devices employed in a motor-powered spring rotation design. For example, in U.S. Pat. No. 4,524,772 to Daar et al, rotational motion of a coil spring provides the loops thereof with continuous motion while they engage and pluck hairs from the skin. In such a design, the improved spring element 10 of the present invention would necessarily increase the overall performance of the device by ensuring hair plucking with a greater degree of certainty.

Having described the invention with regard to a particular embodiment thereof, it is to be understood that the description is not meant as a limitation since further modifications will now become apparent to those skilled in the art, and is intended to cover such modifications as fall within the scope of the appended claims.

I claim:

1. A hair removal device comprising a wire shaped in the configuration of a coil spring having a plurality of loops and an arcuate axis and handle means mounting the coil spring for rotation of the spring about said axis, the surfaces of the wire being roughened about the entire circumference and along the entire length of the wire so that mutually opposed surfaces of adjacent loops of the spring are roughened, whereby the performance of the hair removal device in plucking hairs by entrapment thereof between adjacent loops of the spring when a user rolls the device across a body surface from which hairs are to be removed is substantially enhanced.

2. A hair removal device according to claim 1, wherein said roughened surfaces are provided by a sand-blasting process.

3. A hair removal device according to claim 1, wherein said roughened surfaces are provided by an acid etching process.

4. A hair removal device according to claim 1, wherein said roughened surfaces are provided by contact with rotating wire brushes.

* * * * *